US008171837B2

(12) United States Patent
Asahina et al.

(10) Patent No.: US 8,171,837 B2
(45) Date of Patent: May 8, 2012

(54) PRESSURE CONTAINER

(75) Inventors: Kiyoshi Asahina, Kobe (JP); Ryusuke Kitamura, Kobe (JP); Kenji Tamai, Kobe (JP); Takao Shirakura, Tokyo (JP)

(73) Assignee: Kobe Steel, Ltd., Hyogo (JP)

( * ) Notice: Subject to any disclaimer, the term of this patent is extended or adjusted under 35 U.S.C. 154(b) by 224 days.

(21) Appl. No.: 12/227,157

(22) PCT Filed: Apr. 27, 2007

(86) PCT No.: PCT/JP2007/059174

§ 371 (c)(1),
(2), (4) Date: Nov. 10, 2008

(87) PCT Pub. No.: WO2007/132668

PCT Pub. Date: Nov. 22, 2007

(65) Prior Publication Data

US 2009/0260509 A1 Oct. 22, 2009

(30) Foreign Application Priority Data

May 11, 2006 (JP) ..... 2006-132984

(51) Int. Cl.
*F42B 33/00* (2006.01)

(52) U.S. Cl. ..... 86/50

(58) Field of Classification Search ..... 86/50, 51; 89/1.14, 1.11; 588/403; 110/237; 452/141; 426/234; 73/35.17
See application file for complete search history.

(56) References Cited

U.S. PATENT DOCUMENTS

| | | | | | |
|---|---|---|---|---|---|
| 2,165,935 | A | * | 7/1939 | Menzel | 422/307 |
| 2,917,927 | A | * | 12/1959 | Clark | 73/865.6 |
| 3,721,201 | A | * | 3/1973 | Boller | 109/49.5 |
| 3,800,715 | A | | 4/1974 | Boller | |
| 3,820,435 | A | * | 6/1974 | Rogers et al. | 89/1.1 |
| 4,027,601 | A | * | 6/1977 | Hickerson | 109/1 R |
| 4,437,382 | A | * | 3/1984 | Yerushalmi | 86/50 |
| 5,062,372 | A | * | 11/1991 | Ritter | 110/242 |
| 5,841,056 | A | * | 11/1998 | Long et al. | 86/50 |
| 6,342,186 | B1 | * | 1/2002 | Wingfield et al. | 422/241 |

(Continued)

FOREIGN PATENT DOCUMENTS

JP 7-128000 11/1993

(Continued)

OTHER PUBLICATIONS

International Search Report dated Jul. 17, 2007 regarding PCT/JP2007/059174.

(Continued)

*Primary Examiner* — Troy Chambers
(74) *Attorney, Agent, or Firm* — Stites & Harbison, PLLC; Juan Carlos A. Marquez, Esq

(57) ABSTRACT

It is intended to provide a pressure container which can prevent dispersion of a hazardous substance or the like to the exterior and ensure a high level of safety with a simple structure. To achieve this object, a pressure container (10) comprises an outer vessel (30) and an inner vessel (40) which receives an impact load produced at the time of blasting disposal operation. The inner vessel (40) is disposed inside the outer vessel (30). The inner vessel (40) has a pressure relieving part (50) which can discharge part of high-pressure gas produced in the inner vessel (40) at the time of the blasting disposal operation into a gap formed between the inner vessel (40) and the outer vessel (30).

6 Claims, 3 Drawing Sheets

U.S. PATENT DOCUMENTS

| | | | | |
|---|---|---|---|---|
| 6,647,851 | B2 | 11/2003 | Donovan | |
| 7,398,720 | B2 | 7/2008 | Fujiwara et al. | |
| 2003/0209133 | A1* | 11/2003 | Greenfield et al. | 86/50 |
| 2007/0144637 | A1 | 6/2007 | Fujiwara et al. | |
| 2009/0044690 | A1* | 2/2009 | King | 86/50 |

FOREIGN PATENT DOCUMENTS

| | | |
|---|---|---|
| JP | 7-208899 | 1/1994 |
| JP | 7-286886 | 4/1994 |
| JP | 7-148476 | 7/1994 |
| JP | 3354720 | 8/1994 |
| JP | 2005-515394 | 12/2002 |
| JP | 2005-207623 | 1/2004 |
| JP | 2005-291514 | 3/2004 |
| WO | WO 2005-090896 A1 | 9/2005 |
| WO | WO 2007/132668 A1 | 4/2007 |

OTHER PUBLICATIONS

An Office Action from Japanese Patent Office dated Jul. 10, 2008 regarding Japanese Patent Application No. 2006-132984, in Japanese with English translation.

Extended European Search Report from the European Patent Office on Jul. 20, 2011, in the corresponding PCT Application No. PCT/JP2007/059174 (6 pages).

* cited by examiner

PRESSURE CONTAINER

TECHNICAL FIELD

The present invention relates to a pressure container in which an object to be blasted, such as a hazardous substance or a weapon, is disposed of by blasting operation.

BACKGROUND ART

A known structure of military ammunition used as chemical weapons or the like (such as projectiles, bombs, land mines and naval mines) is such that an internal space of a steel bomb shell is filled with a bursting charge and a chemical agent hazardous to human bodies. Mustard gas and lewisite hazardous to human bodies are examples of such chemical agents.

A known method of disposing of (e.g., detoxifying) the aforementioned chemical weapons and hazardous substances such as organic halogen or the like is blasting disposal operation. The blasting disposal method does not require disassembling operation. This blasting disposal method is therefore applicable not only to disposal of a favorably preserved chemical weapon or the like but also to disposal of a chemical weapon or the like which has become difficult to disassemble due to deterioration over time or deformation. Furthermore, the blasting disposal operation produces ultrahigh temperature and ultrahigh pressure in a surrounding area of the chemical weapon or the like, so that almost all of the chemical agents can be decomposed by use of the blasting disposal method. This kind of blasting disposal method is disclosed in Patent Document 1, for example.

Patent Document 1: Japanese Unexamined Patent Publication No. 7-286886

DISCLOSURE OF THE INVENTION

In the blasting disposal method, the chemical weapons or the like are often disposed of in a sealed pressure container. This approach is used to prevent leakage of the chemical agents to the exterior and to reduce propagation of noise and vibration to the exterior. In a case where this kind of sealed pressure container is used, it is desired to provide a safety valve or the like so that part of pressure developed in the pressure container is released to the exterior through the safety valve or the like when the pressure becomes equal to or higher than a specified value, thereby preventing breakage of the container, for instance.

In the blasting operation for disposal of the aforementioned chemical weapons or the like, however, the pressure in the container rapidly rises within an extremely short period of time (a few milliseconds). An ordinary safety valve like a rupture disk can not sufficiently respond to such a rapid pressure increase. For this reason, the pressure container is required to bear by itself an impact caused by the blasting operation and, therefore, the pressure container would suffer such damages as significant scars and dents after a small number of blasting operations. As a consequence, it becomes necessary to replace the pressure container after a small number of blasting operations. The pressure container used in the aforementioned blasting disposal operation is large-sized, so that a task of replacing the pressure container requires much labor and cost. Therefore, should the need arise to replace the pressure container early after a small number of blasting operations as mentioned above, there arises a problem that the pressure container is an extremely inefficient device. On the other hand, in the aforementioned blasting disposal operation, it is desired to prevent releasing of hazardous substances contained in the chemical weapons or the like accommodated in the pressure container to the atmosphere particularly from an environmental point of view.

Accordingly, it is an object of the invention to provide a pressure container used for performing blasting disposal operation that can prevent dispersion of a hazardous substance to the exterior and ensure a high level of safety with a simple structure.

To achieve this object, the present invention provides a pressure container for disposing of an object to be treated by blasting operation performed therein, the pressure container comprising a sealable outer vessel constituting an outer shell of the pressure container, and an inner vessel disposed inside the outer vessel for receiving an impact load produced at the time of blasting, wherein the inner vessel has a pressure relieving part which can discharge part of high-pressure gas produced in the inner vessel at the time of blasting into a gap between the inner vessel and the outer vessel.

According to this structure, the inner vessel receives the impact load produced at the time of blasting and thereby reduces damages to the outer vessel caused by the impact load. Thus, it is possible to perform the blasting disposal operation using the same pressure container upon replacing the damaged inner vessel alone. This serves to reduce labor and cost required for replacement work, compared to a case where the outer vessel needs to be replaced. Furthermore, part of the high-pressure gas produced as a result of the blasting operation is discharged to the exterior of the inner vessel through the pressure relieving part, so that the risk of bursting of the inner vessel caused by the high-pressure gas, for instance, is reduced. This serves to reduce damages to the inner vessel and ensure safety of the blasting operation. Moreover, hazardous substances discharged into the gap between the inner vessel and the outer vessel remain within the sealed outer vessel. This serves to prevent the hazardous substances from being released into the atmosphere, thereby reducing adverse effects to the environment.

BEST MODE FOR CARRYING OUT THE INVENTION

A pressure container according to an embodiment of the present invention is described below with reference to the drawings.

First, an explosive object to be disposed of by blasting operation in the pressure container of the present embodiment is described. As an example of the explosive object, a chemical bomb which is a chemical weapon is explained with reference to FIG. 3, which is a cross-sectional diagram generally showing the construction of the chemical bomb.

Figure 3:
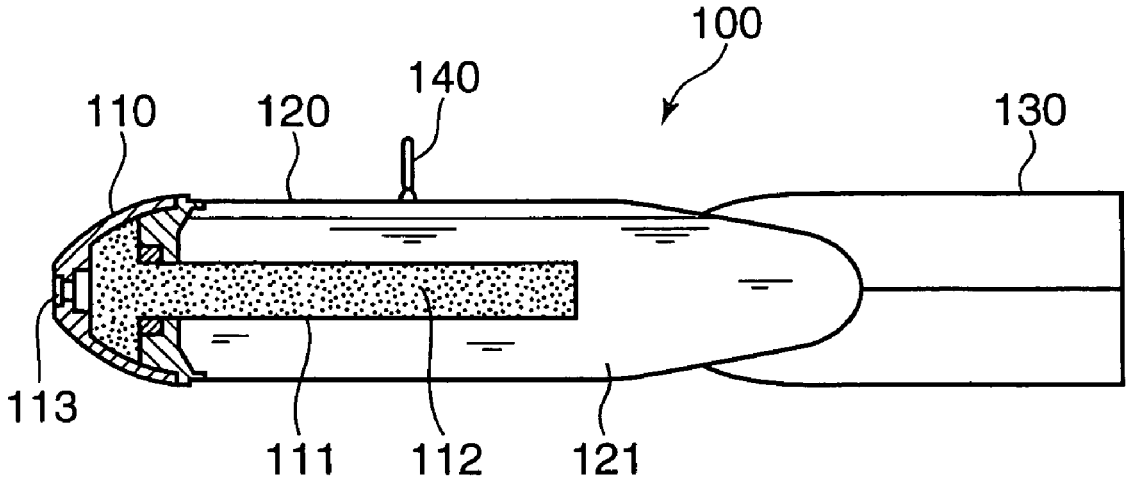
FIG. 3 is a cross-sectional diagram showing an example of a chemical bomb disposed of in the pressure container according to the present invention.

The chemical bomb (explosive object) 100 shown in FIG. 3 has a nose 110, a burster tube 111, a bomb shell 120 and attitude-controlling fins 130.

The burster tube 111 is shaped to extend rearward from the nose 110. The burster tube 111 contains a bursting charge (explosive) 112. The nose 110 is provided a fuze 113 for detonating the bursting charge 112.

The bomb shell 120 is connected to the nose 110, the bomb shell 120 accommodating therein the burster tube 111. An internal space of the bomb shell 120 is filled with a liquid chemical agent (hazardous substance) 121. The attitude-controlling fins 130 are located at an end of the bomb shell 120 opposite to the nose 110 in an axial direction of the bomb shell 120. These attitude-controlling fins 130 serve to control the attitude of the chemical bomb 100 when the chemical bomb 100 is dropped.

Attached to an upper part of the bomb shell 120 is a hoist ring 140 used for suspending the chemical bomb 100. The chemical bomb 100 is hoisted by means of the hoist ring 140 and is subsequently loaded on an airplane or the like.

The explosive object to be disposed of in the present embodiment is the entirety or part of the chemical bomb 100 containing the bursting charge 112 and the chemical agent 121 as described above. The present invention is not limited to disposal of the chemical bomb 100 filled with the chemical agent 121 as mentioned above but is also applicable to disposal of the burster tube 111 alone after disassembly of the chemical bomb 100.

The present invention is applicable to blasting disposal of such military explosives as TNT, picric acid and RDX, for instance. The present invention is also applicable to blasting disposal of blister agents like mustard and lewisite, vomiting agents like DC and DA, as well as such chemical agents as phosgene, sarin and hydrocyanic acid.

Furthermore, the pressure container of the present embodiment is usable not only for blasting disposal of the chemical bomb 100 cited above but also for blasting disposal of such a hazardous substance as organic halogen stored in a container, for example.

Next, as an example of a facility in which an explosive object like the aforementioned chemical bomb 100 is disposed of, a blasting treatment facility installed outdoors is described with reference to FIG. 1, which is a schematic diagram generally showing the configuration of the blasting treatment facility 1.

Figure 1:
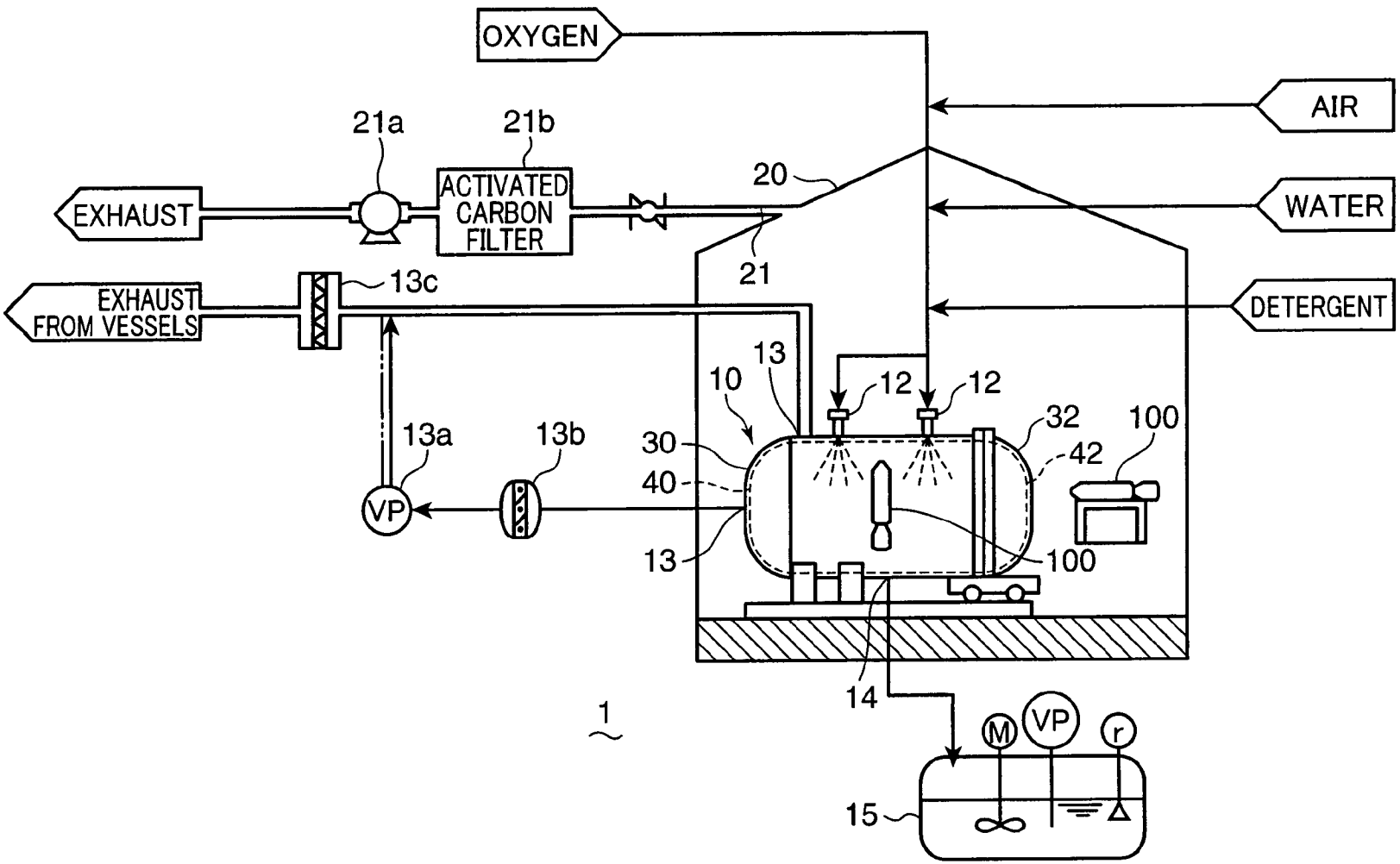
FIG. 1 is a diagram showing an overall configuration of a blasting treatment facility according to the present invention.

The blasting treatment facility 1 shown in FIG. 1 includes as principal constituent elements thereof a pressure container 10 and a tent 20 in which the pressure container 10 is accommodated.

Constructed of steel or the like, the pressure container 10 has an explosion-proof structure. Specifically, the pressure container 10 is made rigid enough to have a strength to withstand a detonation pressure produced when an explosive object like the chemical bomb 100 is disposed of by the blasting operation inside the pressure container 10. Also, the pressure container 10 is constructed so rigidly that hazardous substances or the like produced by the blasting operation would not leak to the exterior.

The structure of the pressure container 10 is now described in detail with reference to FIG. 2, which is a cross-sectional diagram generally showing the structure of the pressure container 10.

Figure 2:
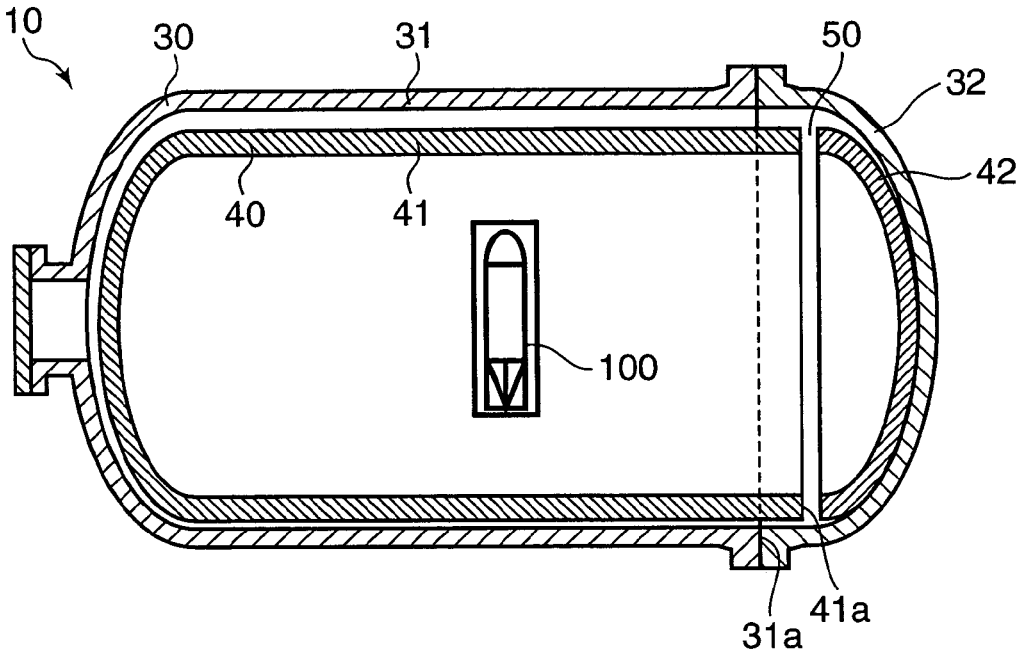
FIG. 2 is a general cross-sectional diagram of a pressure container according to the present invention.

As shown in FIG. 2, the pressure container 10 has a double-layered structure including an outer vessel 30 and an inner vessel 40.

The outer vessel 30 is a strong pressure-resistant receptacle made of steel or the like. The outer vessel 30 has a sufficient strength to bear an impact produced at the time of blasting. The outer vessel 30 also has such stiffness that is high enough to prevent outward leakage of hazardous substances or the like internally produced during the blasting operation.

The outer vessel 30 has a cylindrical shape, including a main outer vessel body 31 and an outer lid 32. The main outer vessel body 31 has an outer opening 31*a* formed in one end in an axial direction of the main outer vessel body 31 opening to the exterior thereof. The outer lid 32 is attachable and removable to and from the main outer vessel body 31. The outer vessel 30 is sealed off when the outer lid 32 is closed.

Like the above-described outer vessel 30, the inner vessel 40 has a cylindrical shape. The inner vessel 40 is manufactured with such a rigid material as steel or the like so that the inner vessel 40 can bear an impact load produced therein at the time of blasting and withstand collisions with flying fragments of the bomb shell. There is formed an inner opening 41*a* in one end in a longitudinal direction of the inner vessel 40.

The inner vessel 40 includes a main inner vessel body 41 and an inner lid 42. The inner opening 41*a* opening to the exterior is formed in the main inner vessel body 41 at one end in an axial direction thereof. The inner lid 42 is mounted at a position where a specific gap 50 (pressure relieving part) is created between the main inner vessel body 41 and the inner lid 42 in such a fashion that the inner lid 42 can be displaced relative to the main inner vessel body 41. The inner lid 42 is attachable and removable to and from the main inner vessel body 41. The inner lid 42 is provided on a side corresponding to the aforementioned outer lid 32, and these lids 32, 42 are so configured that the lids 32, 42 can easily be opened and closed.

The inner vessel 40 is not tightly affixed to the outer vessel 30. Specifically, the inner vessel 40 is loosely mounted so that the inner vessel 40 can be slightly displaced relative to the outer vessel 30. In addition, the inner vessel 40 has such a shape that a specific space is created between the inner vessel 40 and the outer vessel 30.

In an upper part of the pressure container 10 thus configured with the outer vessel 30 and the inner vessel 40, there are provided a plurality of injection ports 12. These injection ports 12 are used for injecting oxygen into the pressure container 10 prior to the blasting operation and for injecting air, water and detergent, for instance, into the pressure container 10 when carrying out a decontamination process after the blasting operation.

Also, in one end and an upper part of the pressure container 10, there are provided exhaust ports 13. These exhaust ports 13 are used for discharging air from inside the pressure container 10 through a filter 13*b* to create a decompressed or vacuum state in the pressure container 10 by using a vacuum pump 13*a* prior to the blasting operation and for discharging gases from inside the pressure container 10 through a filter 13*c* after the blasting operation.

There is provided a drainage port 14 in a bottom part of the pressure container 10. The drainage port 14 is for discharging liquid waste from inside the pressure container 10 into a treatment tank 15 after the decontamination process. This means that the liquid waste is discharged into the treatment tank 15 through the drainage port 14 after the decontamination process.

On the outside of the pressure container 10, there is provided an unillustrated ignition device. The ignition device is for igniting the explosive object like the chemical bomb 100 affixed inside the pressure container 10. The ignition device is so configured as to permit remotely-controlled execution of the blasting operation.

A strong wall surrounding the pressure container 10 should preferably be formed so that the tent 20 will be protected even if the explosive object like the chemical bomb 100 destroys by any chance the pressure container 10.

The tent 20 has an unillustrated door. The pressure container 10 and the explosive object like the chemical bomb 100 are carried into the tent 20 with this door opened. The tent 20 is provided also with an exhaust vent 21 which is connected to a blower 21*a* for ventilating the interior of the tent 20 through a filter 21*b* containing activated carbon, for example.

Next, the working of the pressure container 10 when the chemical bomb 100 is disposed of by the blasting operation in the blasting treatment facility 1 is described.

First, the chemical bomb 100 is placed within the inner vessel 40 of the pressure container 10 in the blasting treatment facility 1, and the inner lid 42 and the outer lid 32 are closed to seal off the outer vessel 30. Then, the chemical bomb 100 is blasted by the unillustrated ignition device.

When the chemical bomb 100 detonates, an impact load produced by detonation is applied to the pressure container 10. Since the pressure container 10 has a double-layered structure including the outer vessel 30 and the inner vessel 40 as mentioned earlier, the inner vessel 40 receives this impact load. Also, after the occurrence of the impact load, high-pressure gases associated with a secondary impact load caused by reflection of the aforementioned impact load, for instance, fill out the interior of the inner vessel 40. The high-pressure gases and dust and dirt or the like escape to the outside of the inner vessel 40 through the gap 50 formed between the main inner vessel body 41 and the inner lid 42, however. For this reason, an excessive pressure increase in the inner vessel 40 due to the high-pressure gas is suppressed. Moreover, the inner lid 42 is mounted in such a manner that the inner lid 42 can be displaced relative to the main inner vessel body 41 as mentioned above, so that the aforementioned impact load spreads out the gap 50, thereby accelerating discharging of gases.

On the other hand, the outer vessel 30 is provided on the outside of the inner vessel 40. Therefore, the high-pressure gases which have escaped to the outside of the inner vessel 40 through the gap 50 are retained within the outer vessel 30. This serves to suppress a release of the high-pressure gases containing hazardous substances into the atmosphere.

A period of time during which the impact load is produced by detonation is just a few milliseconds, which is so extremely short that the impact load is scarcely transmitted to the outer vessel 30 through the gap 50. Therefore, the inner vessel 40 receives this impact load as mentioned above, thereby reducing damages to the outer vessel 30 by the impact load.

As thus far described, the pressure container 10 of the present embodiment is provided with the inner vessel 40 which protects the outer vessel 30 by receiving the impact load occurring at the time of blasting in addition to the outer vessel 30 having the strength to bear a pressure produced at the time of blasting, so that damages to the outer vessel 30 are reduced. For this reason, it is not necessary to replace the entirety of the pressure container 10 including the thick-walled outer vessel 30 which is required to have a rigid structure and the blasting operation can be recommenced by replacing the inner vessel 40 alone. In addition, even if a crack or the like occurs in the inner vessel 40, it is simply needed to have the crack function as a pressure relieving part. Therefore, unlike the outer vessel 30, the inner vessel 40 is not required to have such a strength and sealing structure that prevent leakage of the high-pressure gases and hazardous substances produced at the time of blasting. Accordingly, the inner vessel 40 may employ a simple structure compared to the outer vessel 30. This means that, compared to the conventional pressure container, the aforementioned pressure container 10 reduces running cost of the blasting treatment facility 1.

Also, if the main inner vessel body 41 and the inner lid 42 are positioned apart from each other so that the gap 50 is created therebetween and this gap 50 is used as a pressure relieving part as discussed earlier, it is not necessary to additionally provide a pressure relieving part in the inner vessel 40. This serves to simplify the structure of the inner vessel 40. Additionally, if the inner lid 42 is mounted in such a manner that the inner lid 42 can be displaced relative to the main inner vessel body 41, the gap between the main inner vessel body 41 and the inner lid 42 automatically spreads out according to the magnitude of the impact load. It is therefore possible to efficiently discharge the high-pressure gases from inside the inner vessel 40 to the exterior through this gap.

Furthermore, if the inner vessel 40 is made attachable and removable to and from the outer vessel 30, replacement work of the inner vessel 40 becomes easier.

In addition, if the outer vessel 30 has a shape extending in a specific direction and is provided with the outer lid 32 for opening and closing the outer opening 31*a* of the main outer vessel body 31 at one end in a longitudinal direction of the outer vessel 30 while the inner vessel 40 has a shape extending in a specific direction and is provided with the inner lid 42 for opening and closing the inner opening 41*a* of the main inner vessel body 41 on the side corresponding to the outer lid 32 as discussed earlier, tasks for conveying the chemical bomb 100 or the like into the pressure container 10 and for removing fragments or the like after the blasting operation become easier. It follows that the time required for carrying out these tasks is shortened.

The present invention embraces an arrangement in which the aforementioned inner vessel 40 is divided into a plurality of chambers which are disposed in such a way that the individual chambers are separated from one another by a gap formed therebetween. In this case, the gap can be used as a pressure relieving part. In addition, it is possible to recommence the blasting operation by replacing only a seriously damaged one of the multiple chambers. This serves to further decrease running cost of the pressure container 10.

Furthermore, it is possible to use such an inner vessel 40 having a through hole formed in an outer wall thereof so that the interior of the inner vessel 40 is connected to the interior of the outer vessel 30 through the through hole. In this case, the through hole can be used as a pressure relieving part.

The present invention also embraces an arrangement in which the inner vessel 40 is tightly affixed to the outer vessel 30. However, in the above-described arrangement in which the inner vessel 40 is loosely fitted in the outer vessel 30, an impact produced at the time of blasting operation is unlikely to be directly transmitted to the outer vessel 30 and, as a consequence, an excessive force would not be applied to a joint portion between the inner vessel 40 and the outer vessel 30. Hence, damages to this joint portion are reduced and, thus, durability of the pressure container 10 is further improved.

The present invention also embraces an arrangement in which the pressure container 10 is placed underground under conditions where an explosive object is contained therein and disposed of by underground blasting operation.

The invention claimed is:

1. A pressure container for disposing of an object to be treated by a blasting operation performed therein, said pressure container comprising:

a sealable outer vessel constituting an outer shell of said pressure container; and an inner vessel disposed inside said outer vessel for receiving an impact load produced at the time of the blasting operation;

wherein said inner vessel includes a main inner vessel body and an inner lid, the main inner vessel body has an inner opening, the inner lid is provided outside of the main inner vessel body and faces the inner opening, the main inner vessel body and the inner lid are separated from each other so that a gap is formed between an end edge of the main inner vessel body surrounding the inner opening and a circumferential edge of the inner lid facing the end edge of the main inner vessel body, the gap serves as a pressure relieving part which can discharge part of high-pressure gas produced in said inner vessel at the time of blasting operation into a gap between said inner vessel and said outer vessel, and the inner lid is disposed inside the outer vessel in such a manner that the inner lid can be displaced outwardly in response to said blasting relative to the main inner vessel body so that the gap between the end edge of the main inner vessel body and the circumferential edge of the inner lid spreads out in response to said blasting, said outer vessel includes a main outer vessel body and an outer lid, the main outer vessel body has an interior space for housing the inner vessel and an outer opening communicated with the interior space, the outer lid closes up the outer opening so that the main outer vessel body is sealed off.

2. The pressure container as recited in claim 1, wherein said inner vessel is divided into a plurality of chambers which are separated from one another so that a gap is formed therebetween, and part of the high-pressure gas is discharged into the gap between said inner vessel and said outer vessel through the gap which is formed between one chamber and another.

3. The pressure container as recited in claim 1, wherein said inner vessel has a through hole formed in an outer wall passing therethrough, and part of the high-pressure gas is discharged into the gap between said inner vessel and said outer vessel through the through hole.

4. The pressure container as recited in claim 1, wherein said inner vessel is mounted in such a manner that said inner vessel can be displaced relative to said outer vessel.

5. The pressure container as recited in claim 1, wherein said outer vessel has a shape extending in a specific direction and includes a main outer vessel body having at one of two ends thereof an outer opening and an outer lid for opening and closing the outer opening, said inner vessel has a shape extending in a specific direction, the inner opening is located at one of two ends of the main inner vessel body, and the inner lid is provided on a side corresponding to the outer lid for opening and closing the inner opening.

6. The pressure container as recited in claim 1, wherein said inner vessel is disposed in such a manner that said inner vessel can be attached to and removed from said outer vessel.

* * * * *